US011043081B2

(12) United States Patent
Baker

(10) Patent No.: US 11,043,081 B2
(45) Date of Patent: Jun. 22, 2021

(54) METHOD AND SYSTEM FOR CONDUCTING A WAGERING GAME

(71) Applicant: Kenneth Baker, Las Vegas, NV (US)

(72) Inventor: Kenneth Baker, Las Vegas, NV (US)

( * ) Notice: Subject to any disclaimer, the term of this patent is extended or adjusted under 35 U.S.C. 154(b) by 0 days.

(21) Appl. No.: 16/880,840

(22) Filed: May 21, 2020

(65) Prior Publication Data

US 2021/0110672 A1 Apr. 15, 2021

Related U.S. Application Data

(60) Provisional application No. 62/851,015, filed on May 21, 2019.

(51) Int. Cl.
*G07F 17/32* (2006.01)

(52) U.S. Cl.
CPC ..... *G07F 17/3293* (2013.01); *G07F 17/3211* (2013.01); *G07F 17/3244* (2013.01)

(58) Field of Classification Search
USPC ..... 463/13, 12, 11
See application file for complete search history.

(56) References Cited

U.S. PATENT DOCUMENTS

| | | | | |
|---|---|---|---|---|
| 2010/0227661 | A1* | 9/2010 | Walker | G07F 17/32 463/13 |
| 2012/0088563 | A1* | 4/2012 | Smith | G07F 17/3293 463/13 |
| 2019/0188959 | A1* | 6/2019 | Lutnick | G07F 17/3244 |
| 2020/0134980 | A1* | 4/2020 | Lutnick | G07F 17/3276 |
| 2020/0143633 | A1* | 5/2020 | Alderucci | G06Q 20/207 |
| 2020/0160666 | A1* | 5/2020 | Lutnick | G07F 17/3293 |

* cited by examiner

*Primary Examiner* — Pierre E Elisca
(74) *Attorney, Agent, or Firm* — FisherBroyles, LLP; Rob L. Phillips

(57) ABSTRACT

A wagering game method includes dealing an initial poker hand, forming a final poker hand (optionally by discarding and replacing zero or more playing cards from the initial poker hand), and forming an augmented final poker hand by dealing additional cards to the final poker hand. Optionally, multiple augmented final poker hands may be formed from a single final poker hand by dealing additional cards from different decks to the same final poker hand. The augmented final poker hands are evaluated and a reward is issued based on the payout, if any, associated with the poker rank of each augmented final poker hand.

12 Claims, 6 Drawing Sheets

METHOD AND SYSTEM FOR CONDUCTING A WAGERING GAME

FIELD OF THE INVENTION

The embodiments of the present invention relate to a system and method for conducting video poker games with one or more secondary hands.

BACKGROUND

Conventional video poker involves a simulated deck of 52 cards being shuffled until a player depresses a deal button. At that time, the deck is set (i.e., shuffling stops) and the top five cards in the shuffled deck are displayed face up on the gaming machine display. The player may then select which cards to hold and which to discard. Any discards are replaced by the next cards off the top of the shuffled deck. Depending on the rank of the final five cards, the player receives an award or no award. For example, in one embodiment, a final hand having a rank of a pair of Jacks or better results in an award.

Video poker is a very popular game and many players are chasing royal flushes. Indeed, players track the number of royal flushes they hit. However, it is not easy to hit a royal flush given the odds of doing so with a five-card draw poker hand are about 40,000 to 1.

Accordingly, it would be advantageous to develop a video poker system and method with secondary hands that increase the frequency of hitting royal flushes (or other hard to hit hands (e.g., straight flushes and fours of a kind).

SUMMARY

The embodiments of the present invention provide one or more secondary poker hands which are populated using certain cards dealt into the underlying video poker hand. In one embodiment, any card dealt during the video poker hand, may further be used in the one or more secondary hands. In another embodiment, only cards dealt into the original video poker hand (i.e., prior to any draw) may be used in the one of more secondary hands. Alternatively, only cards in the final video poker hand (i.e., after the draw), may be used in the secondary hands.

A first embodiment of the present invention involves four secondary hands—one designated for each suit—with the objective of obtaining royal flushes using cards from the underlying video poker game. In this embodiment, each of the four secondary hands comprises five card locations with each location reserved for a specific card (10, Jack, Queen, King and Ace) associated with a royal flush in that suit. As certain of the designated cards are dealt into the underlying poker hand they are also positioned in their designated locations in the secondary hands. In one embodiment, the designated cards are any dealt cards, only the five cards in the initial hand or only the cards in the final hand. In one embodiment, the cards remain in the secondary hand locations for a pre-established number of played hands (e.g. 5) of the underlying video poker game and are then removed. If each of the locations of any secondary hand are filled, a secondary royal flush bonus is paid.

In one embodiment, if a designated card appears in the underlying hand and the secondary hand location is filled already, the number of hands the designated card stays in the secondary hand is increased.

Other variations, embodiments and features of the present invention will become evident from the following detailed description, drawings and claims.

DETAILED DESCRIPTION

Figure 1:
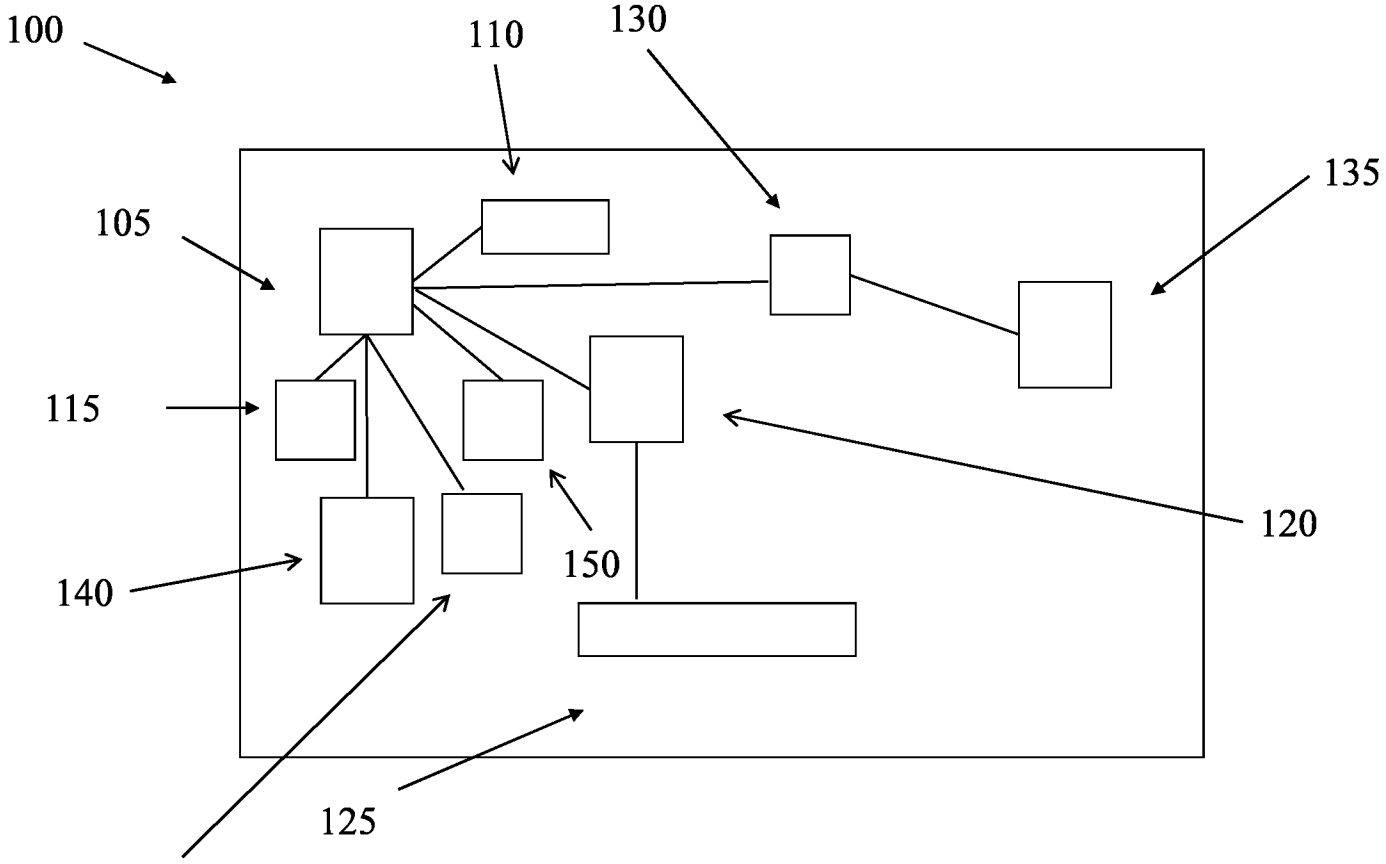
FIG. 1 illustrates a block diagram of components of an electronic gaming device for conducting a game according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

As will be appreciated by one skilled in the art, the embodiments of the present invention combine software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

Computer program code for carrying out operations for embodiments of the present invention may be written in any combination of one or more programming languages, including an object-oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof.

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

Mobile devices as used herein include desktop computers, laptop computers, tablets, smart phones and the like. The embodiments of the present invention may be implemented as a dedicated website and/or mobile application. The use of wager and wagering herein are synonymous with bet and betting.

The embodiments of the present invention relate to a video poker system and method facilitated by a video poker machine. Such video poker machines are well-known in the art so the operational details, other than those relevant hereto, need not be detailed herein. Video poker is a straightforward game that has been popular for decades. The object of the game is to obtain the highest ranking five-card poker hand with one draw opportunity. The game is played as follows: (i) a player makes a bet; (ii) the player inputs a deal instruction at which time a shuffling of virtual cards ceases and the 5 top cards from a deck of 52 virtual cards are presented face up on a video display; (iii) via an interface, the player has the option to discard one, two, three, four or five of the initial cards; (iv) discards, if any, are replaced with the next cards off the virtual deck of playing cards; and (v) payouts, if any, are based on the rank of the hand formed by the final five cards. Table 1 shows a standard pay table for a video poker game with payouts against $1-$5 bets. There are many alternative video-poker pay tables but each of the pay tables is substantially the same with subtle nuances, including enhanced payouts for certain pre-established hands (e.g., four Aces with a 2, 3 or 4 kicker).

TABLE 1

| Hand Type | 5 coins | 4 coins | 3 coins | 2 coins | 1 coin |
|---|---|---|---|---|---|
| Royal Flush | $4000 | $1000 | $750 | $500 | $250 |
| Straight Flush | $250 | $200 | $150 | $100 | $50 |
| 4 of a Kind | $125 | $100 | $75 | $50 | $25 |
| Full House | $45 | $36 | $27 | $18 | $9 |
| Flush | $30 | $24 | $18 | $12 | $6 |
| Straight | $20 | $16 | $12 | $8 | $4 |
| 3 of a Kind | $15 | $12 | $9 | $6 | $3 |
| Two Pair | $10 | $8 | $6 | $4 | $2 |
| Jacks or Better Pair | $5 | $4 | $3 | $2 | $1 |

A block diagram of the electronic gaming device 100 is shown in FIG. 1. The exemplary electronic gaming device 100 may include a central processing unit (CPU) also deemed processor 105 which controls the electronic gaming device 100 based on instructions stored in program read-only memory (ROM) 110 and pay table ROM 115. Program ROM 110 stores executable instructions related to the operation of the gaming device 100 and which are generally permanent. CPU 105 may be connected to a video controller 120 which provides output to one or more video displays 125. Similarly, an audio controller 130 provides audio output as dictated by the CPU 105 through speakers 135. The components, and others, may be attached to a circuit board forming a motherboard. In another embodiment, the electronic gaming device 100 may be linked to a central game server which allows players to select from games via the electronic gaming device 100. In such an embodiment, one or more processors integrated into the central server control the gaming device 100 based on instructions stored in program ROM 110.

A user interface 140 may respond to buttons on button panel or display incorporating touch screen technology or any other devices providing means for users to communicate with, and instruct, the electronic gaming device 100. Wager memory 145 stores an amount of money/credits deposited into the electronic gaming device 100 by a player and specific wager information related to each play of the electronic gaming device 100. Payout system 150 includes a coupon printer or similar device for receiving money/coupon from the electronic gaming device 100.

Those skilled in the art will recognize that the configuration and features of the electronic gaming device 100 disclosed herein are exemplary and may be altered in any number of ways without impacting the embodiments of the present invention.

Figure 2:
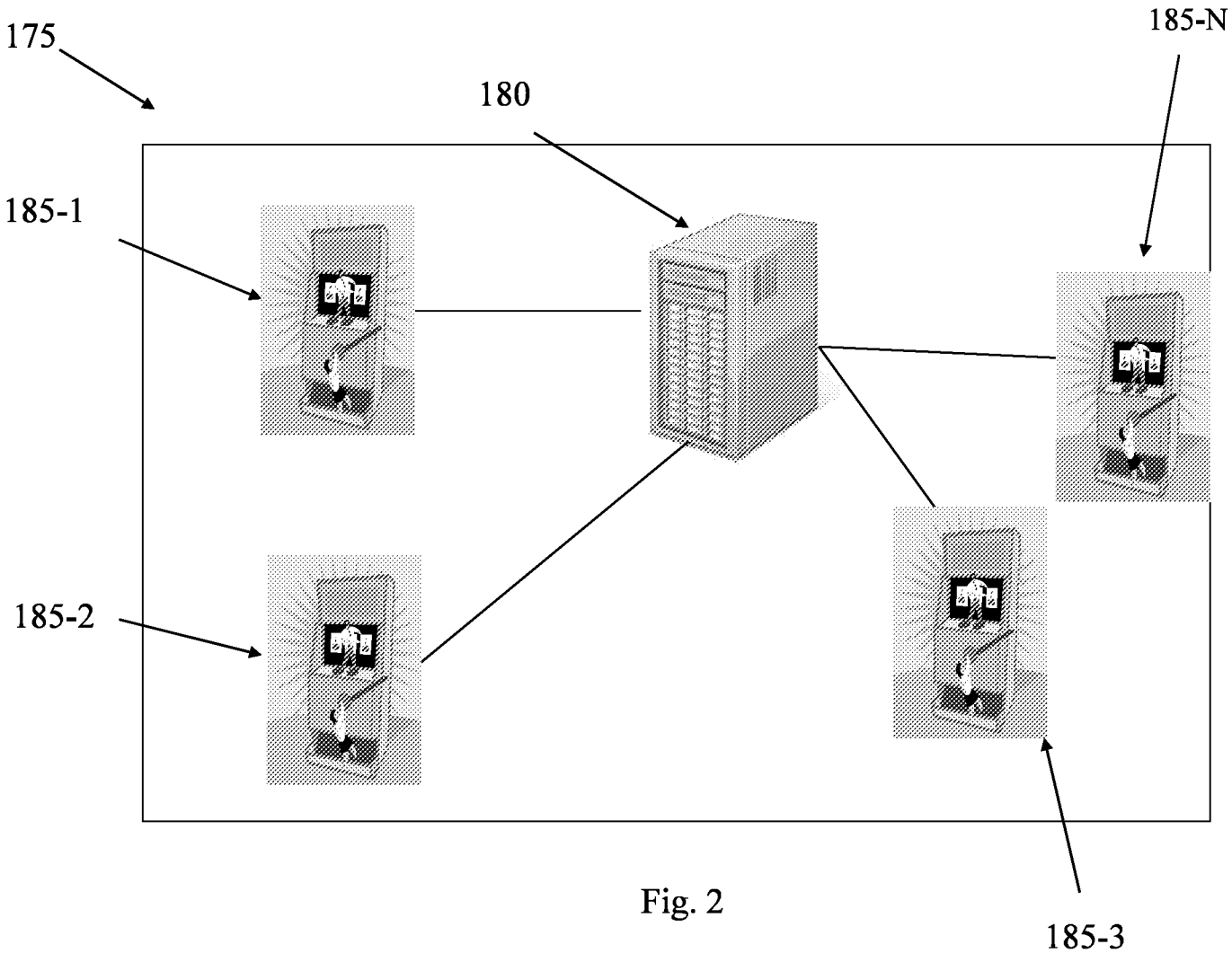
FIG. 2 illustrates a block diagram of a wireless network system including numerous slot machines according to the embodiments of the present invention.

FIG. 2 shows a block diagram of a wired system 175 which may be used to facilitate play of the game according to the embodiments of the present invention. The wired system 175 comprises a central computer 180 running a casino management system or the like and including one or more processors and memory. Standalone gaming devices 185-1 through 185-N (e.g., video machines) configured to facilitate game play.

Figure 3:
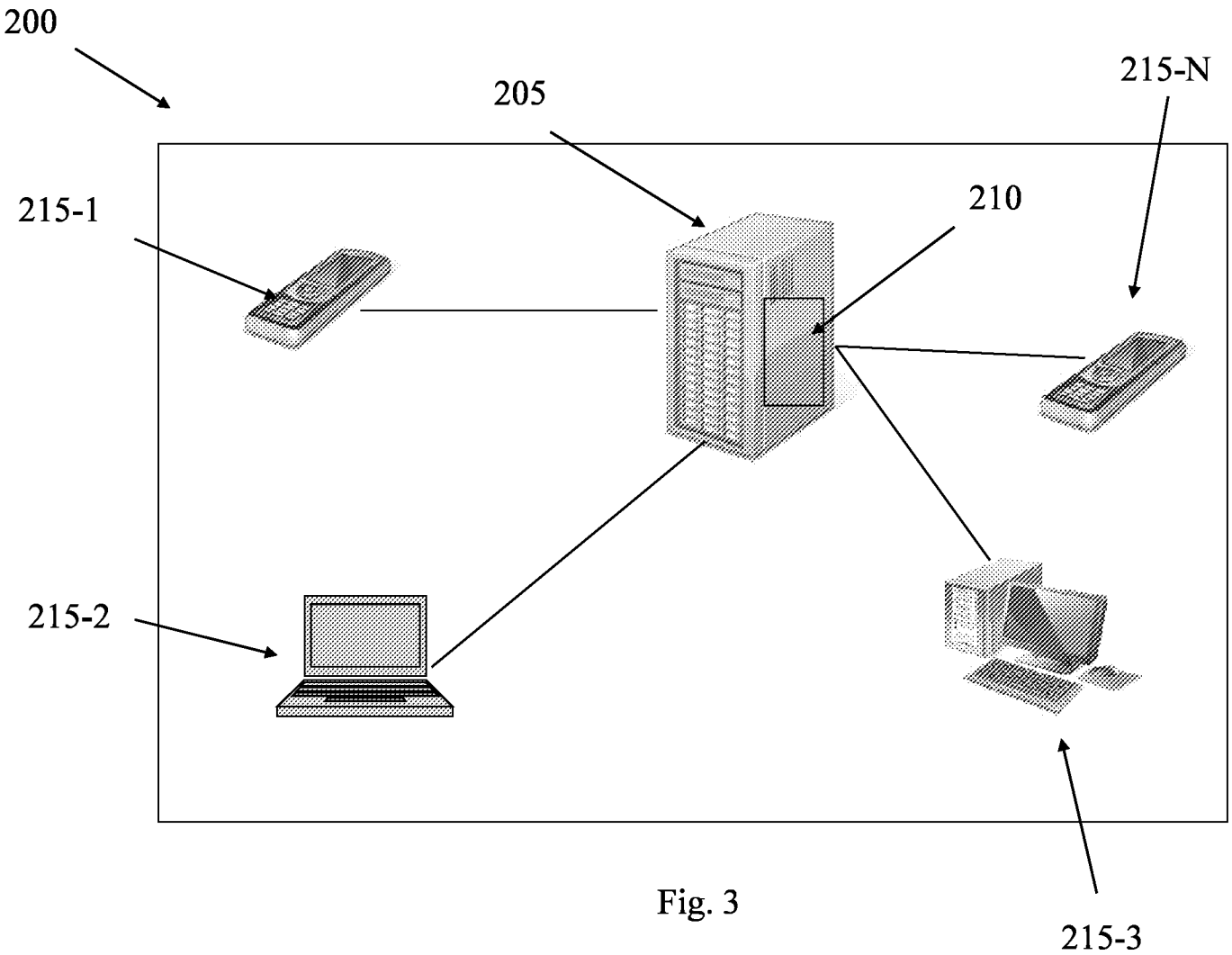
FIG. 3 illustrates a block diagram of a wireless network system accessible by mobile devices for conducting mobile games of chance according to the embodiments of the present invention.

FIG. 3 shows a block diagram of a wireless system 200 which may be used to facilitate remote play of the game according to the embodiments of the present invention. The wireless system 200 comprises a game server 205, including one or more processors 210 running game software, and remote devices 215-1 through 215-N (e.g., smart phones) configured to access said game server 205 facilitating game play on the remote devices 215-1 through 215-N. In another embodiment, the video game according to the embodiments of the present invention may be in the form of a software application ("App") downloadable onto smart phones, tablets or computers and playable via processing power and a user interface associated therewith. Wired connections may be used as well.

The embodiments of the present invention provide additional opportunities for the player to obtain hard-to-achieve poker hands such as Royal Flushes and Straight Flushes. FIG. 4 shows a screen shot 300 of a Royal Flush embodiment of the present invention. In this embodiment, there is the primary video poker hand 305 and four secondary hands 310-1 through 310-4. In other embodiments, there may be a greater or lesser number of secondary hands. For example, in one embodiment, there may be a single secondary hand based on a Royal Flush in spades (or different suit) rather than all four suits as shown in FIG. 4. Each card location associated with each secondary hand 310-1 through 310-4 incudes a counter 315. The counter 315 counts down (or up) how many more hands before each card is removed from the corresponding secondary hand card location. In one embodiment, cards remain in the secondary hand locations for five plays of the primary video poker game.

Figure 4A:
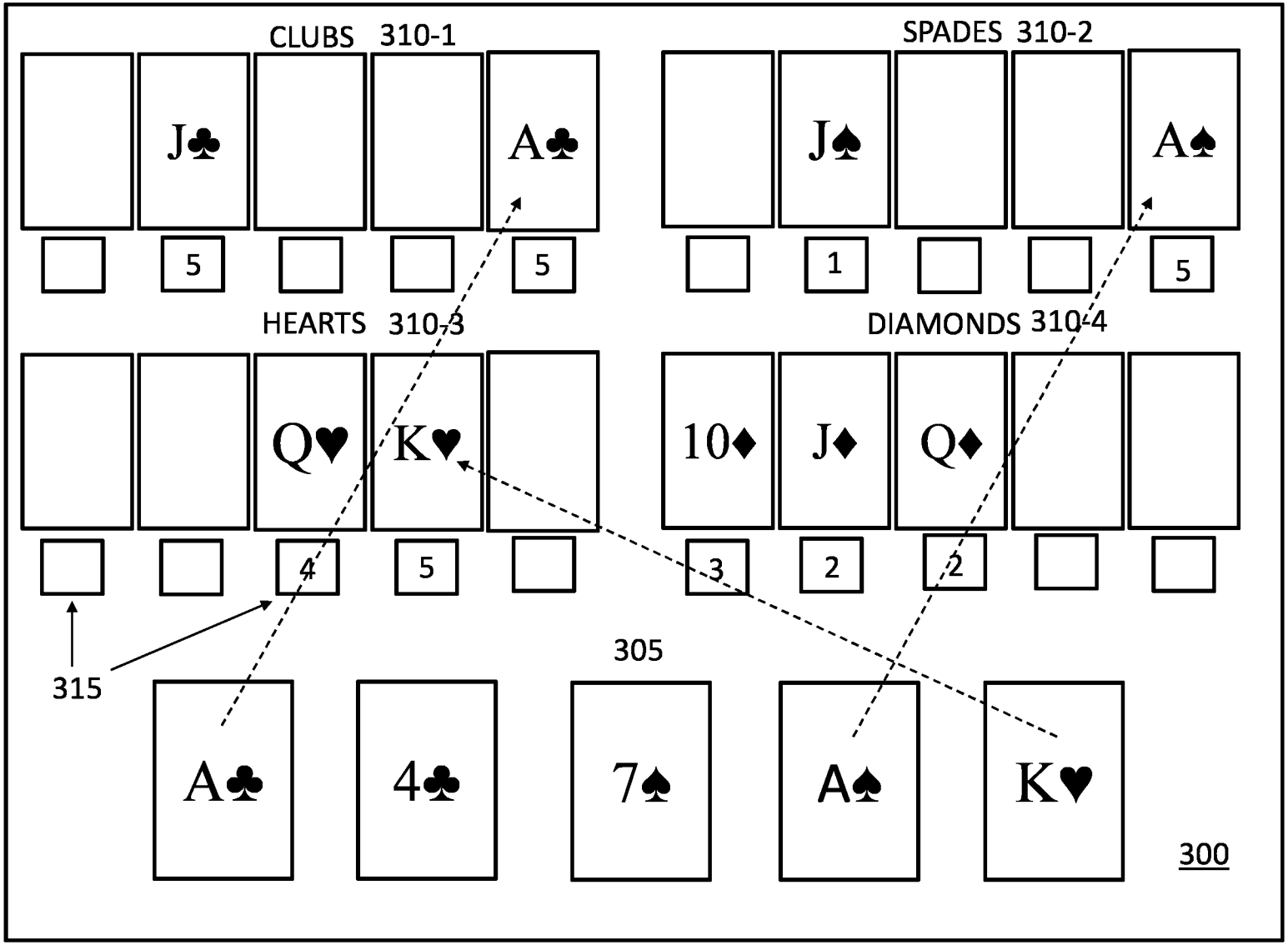
FIG. 4A illustrates a screen shot of an exemplary video poker game played according to the embodiments of the present invention.

As shown in FIG. 4A, the primary video poker hand 305 includes four royal flush cards. Royal Flush cards are the 10, Jack, Queens, King and Ace of each suit thereby comprising 20 cards from the 52-card deck. When the Royal Flush cards appear in the primary video poker hand 305, the Royal Flush cards are also presented in the secondary hands based on their rank and suit. That is, the Royal Flush cards each have a designated location within the secondary hands 310-1 through 310-4. In one embodiment, if a Royal Flush card appears in the primary video poker hand 305 and the designated location in the corresponding secondary hand 310-1 through 310-4 is already populated, the additional number of hands (e.g., 5) or some other number is added to the counter. Alternatively, the counter may remain the same such that the appearance of the repeat Royal Flush card has no impact on the corresponding secondary hand.

Figure 4B:
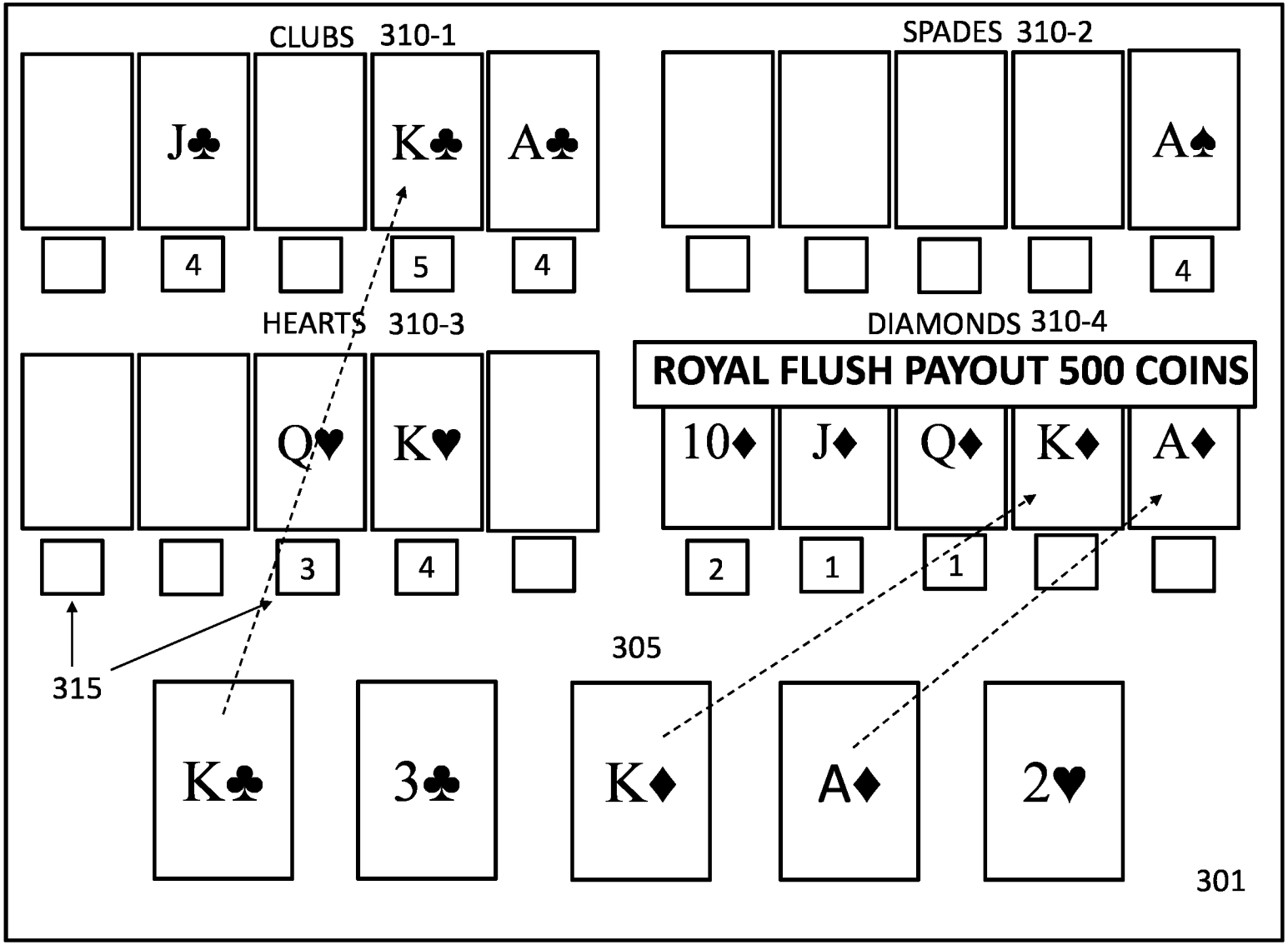
FIG. 4B illustrates a screen shot of an exemplary video poker game with a winning secondary hand according to the embodiments of the present invention.

FIG. 4B shows screen shot 301 after play of the video poker game the next hand after the hand shown in screen shot 300. Given the new play of the primary video poker game 305, each counter has been lowered by 1. As such, since secondary hand 310-2 did not fully populate, the Jack of spades was removed as the count went to zero. The King of clubs from the primary video poker hand 305 has populated secondary hand 310-1. As secondary hand 310-4 is now fully populated, a Royal Flush bonus is paid.

Figure 5:
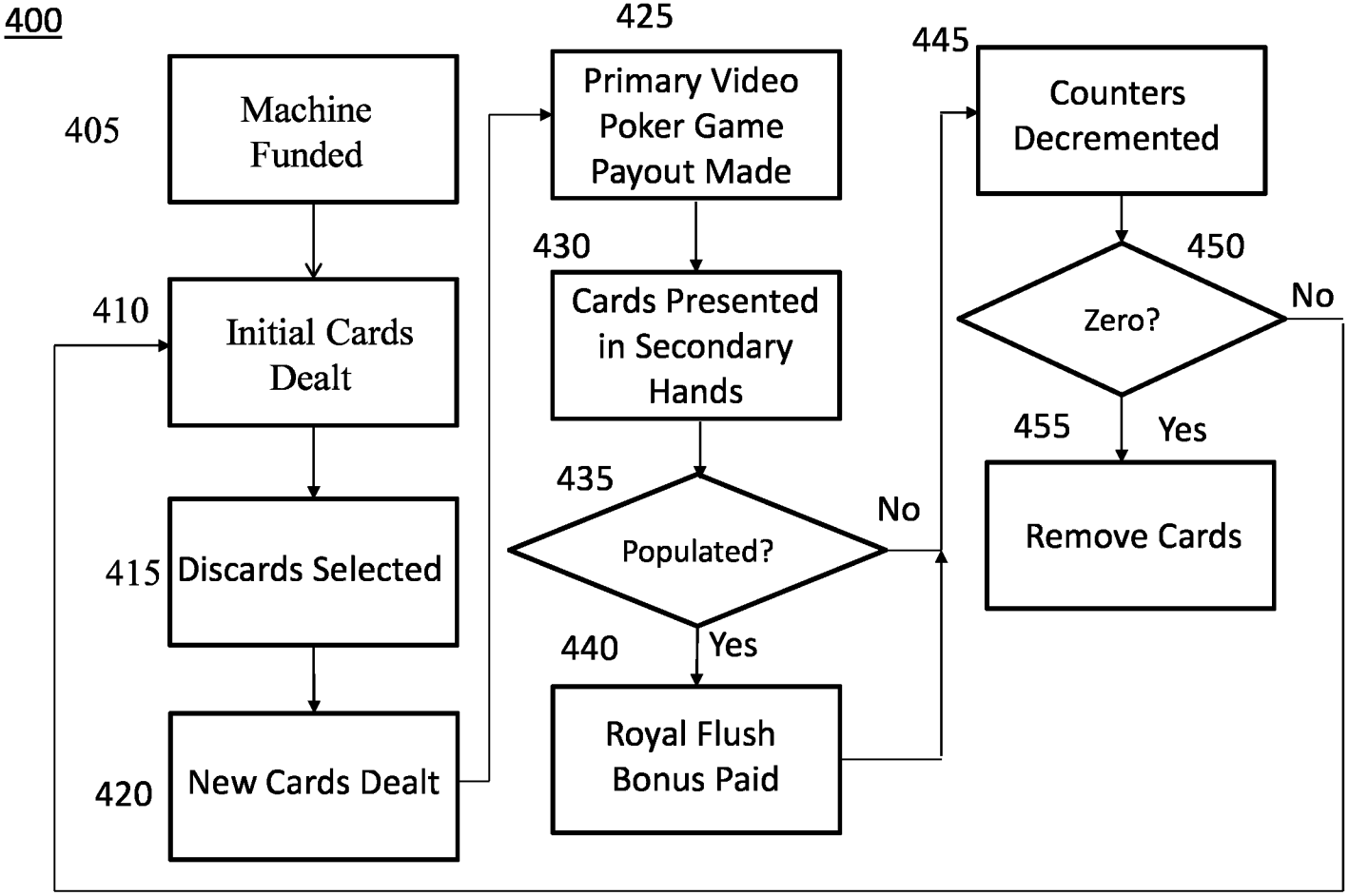
FIG. 5 illustrates a flow chart detailing game play according to the embodiments of the preset invention.

FIG. 5 illustrates a flow chart 400 detailing one methodology of utilizing the system and method disclosed herein using a gaming machine and four secondary hands as detailed above. In this embodiment, only cards in the final video poker hand are presented in the four secondary hands. At 405, the gaming machine is funded by the player using cash, coupons, vouchers, tickets, etc. In one embodiment, playing the four secondary hands does not require any additional player fee. In such an embodiment, the pay table for the winning primary video poker game outcomes is adjusted as needed to maintain the house advantage. Alternatively, players may be required to place an additional wager to play the four secondary hands. At 410, the player hits a DEAL button/icon and the initial five cards of the primary video poker hand are dealt from a virtual deck of 52 playing cards. At 415, via a gaming machine interface, the player selects initial cards, if any, to discard. At 420, the player hits a DEAL button/icon and the selected cards are replaced with new cards from the virtual deck. At 425, any payout associated with the primary video poker hand is paid. Simultaneously, at 430, any Royal Flush cards forming the final primary video poker hand are presented in the corresponding secondary hands. At 435, it is determined if any secondary hand is fully populated. If so, at 440, a Royal Flush bonus is paid. If not, at 445, all counters, except those for the new cards from the most recent video poker hand, are decremented by 1. At 450, it is determined if any counters have reached zero. If so, at 455, the card is removed from the secondary hand. If not, the flow chart 400 loops back to 410 for the next play of the primary video poker hand.

While the detailed description focuses on 5-card draw video poker, other video poker variants may benefit from the embodiments of the present invention. While not detailed above, it is well known that wild cards may be used with video poker and thus the embodiments of the present invention. In another embodiment, a single secondary hand may populate regardless of suit until all five cards are Royal Flush cards of the same suit. For example, if a 10 of spades is in the secondary hand and a 10 of diamonds appears in the primary video poker hand, the 10 of spades is replaced by the 10 of diamonds.

Although the invention has been described in detail with reference to several embodiments, additional variations and modifications exist within the scope and spirit of the invention as described and defined in the following claims.

I claim:

1. A method for conducting a wagering game at a device having a data processor in communication with a data storage device, a display, and a player interface, said data storage device storing, in non-transitory storage, playing cards and program instructions executable by said data processor to conduct a method comprising the steps of:

storing at said data storage device a designation of at least one of said playing cards as a collectible card;

storing at said data storage device a definition of a winning set of collectible cards; and conducting at least one poker game by said data processor comprising:

receiving a wager through said player interface;

dealing a poker hand of playing cards by said data processor and displaying said poker hand at said display;

forming a final poker hand by said data processor and displaying said final poker hand at said display;

displaying at said display a register of collectible cards, if any, dealt to said poker hand;

issuing a reward by said data processor based on said final poker hand; and issuing a reward by said data processor when said register of collectible cards contains a winning set of collectible cards, wherein said register is carried over to a subsequent poker game if said register does not contain a winning set.

2. The method of claim 1 further comprising resetting said register after each poker game by removing collectible cards which have been stored in said register for a predetermined quantity of poker games.

3. The method of claim 1 further comprising displaying multiple registers.

4. The method of claim 3 wherein multiple playing cards are designated as collectible cards and wherein each collectible card is stored, when dealt, in one of said registers.

5. The method of claim 4 wherein each collectible card includes a value and a suit and said collectible cards are stored in separate registers based on suit.

6. The method of claim 5 wherein said playing cards include a conventional poker deck containing the values deuce, three, four, five, six, seven, eight, nine, ten, jack, queen, king, and ace in four suits and said collectible cards include the ten, jack, queen, king, and ace of each suit.

7. A device for conducting a wagering game comprising:

a data processor;

a display in communication with said data processor;

a player interface in communication with said data processor; and a data storage device in communication with said data processor, said data storage device storing, in non-transitory storage, playing cards and program instructions executable by said data processor to conduct a wagering game comprising the steps of:

storing at said data storage device a designation of at least one of said playing cards as a collectible card;

storing at said data storage device a definition of a winning set of collectible cards; and conducting at least one poker game by said data processor comprising:

receiving a wager through said player interface;

dealing a poker hand of playing cards by said data processor and displaying said poker hand at said display;

forming a final poker hand by said data processor and displaying said final poker hand at said display;

displaying at said display a register of collectible cards, if any, dealt to said poker hand;

issuing a reward by said data processor based on said final poker hand; and issuing a reward by said data processor when said register of collectible cards contains a winning set of collectible cards, wherein said register is carried over to a subsequent poker game if said register does not contain a winning set.

8. The device of claim 7 wherein said program instructions further comprise resetting said register after each poker game by removing collectible cards which have been stored in said register for a predetermined quantity of poker games.

9. The device of claim 7 further comprising displaying multiple registers.

10. The device of claim 9 wherein multiple playing cards are designated as collectible cards and wherein each collectible card is stored, when dealt, in one of said registers.

11. The device of claim 10 wherein each collectible card includes a value and a suit and said collectible cards are stored in separate registers based on suit.

12. The device of claim 11 wherein said playing cards include a conventional poker deck containing the values deuce, three, four, five, six, seven, eight, nine, ten, jack, queen, king, and ace in four suits and said collectible cards include the ten, jack, queen, king, and ace of each suit.

* * * * *